US010301082B2

(12) United States Patent
Slack

(10) Patent No.: US 10,301,082 B2
(45) Date of Patent: May 28, 2019

(54) RIM FOR A CONTAINER

(71) Applicant: FRUGALPAC LIMITED, Brightwell, Ipswich (GB)

(72) Inventor: Henry William Slack, London (GB)

(73) Assignee: Prugalpac Limited, Brightwall, Ipswich (GB)

( * ) Notice: Subject to any disclaimer, the term of this patent is extended or adjusted under 35 U.S.C. 154(b) by 0 days.

(21) Appl. No.: 15/522,185

(22) PCT Filed: Nov. 11, 2015

(86) PCT No.: PCT/GB2015/053411
§ 371 (c)(1),
(2) Date: Apr. 26, 2017

(87) PCT Pub. No.: WO2016/075458
PCT Pub. Date: May 19, 2016

(65) Prior Publication Data

US 2017/0313477 A1 Nov. 2, 2017

(30) Foreign Application Priority Data

Nov. 13, 2014 (WO) ..... PCT/GB2014/053361
May 13, 2015 (GB) ..... 1508134.2

(51) Int. Cl.
*B65D 45/32* (2006.01)
*B65D 25/16* (2006.01)
(Continued)

(52) U.S. Cl.
CPC ..... *B65D 45/32* (2013.01); *B65D 21/0219* (2013.01); *B65D 21/0233* (2013.01);
(Continued)

(58) Field of Classification Search
CPC ..... B65D 45/32; B65D 21/0219; B65D 43/0208; B65D 25/32; B65D 43/0212;
(Continued)

(56) References Cited

U.S. PATENT DOCUMENTS 3,499,574 A 3/1970 Yates, Jr.
3,734,393 A 5/1973 Stump
(Continued)

FOREIGN PATENT DOCUMENTS

CN 101863331 A 10/2010
CN 203381893 U 1/2014
(Continued)

OTHER PUBLICATIONS

U.S. Appl. No. 15/034,941, filed May 6, 2016, Henry William Slack.
(Continued)

*Primary Examiner* — Kareen K Thomas
(74) *Attorney, Agent, or Firm* — Burr & Brown, PLLC

(57) ABSTRACT

A rim assembly for a container comprises a frame member (346) having a perimeter corresponding in shape to an opening of a container such that, in use, the frame member is received within the opening and extends around an interior surface of a side wall of the container; a plurality of securing tabs (394) hingedly connected to the frame member (346), each tab (394) including an engagement member (396); sealing means configured for repeated sealing engagement with a lid of the container; and retaining means (399), wherein each of the securing tabs is movable between a first position in which the engagement member is disengaged from an aperture (317) in the container side wall and a second position in which the engagement member (396) is engaged with one of the apertures (317) in the side wall, and wherein the retaining means is configured to retain the
(Continued)

securing tabs in the second position such that the rim assembly is secured to the container around a top edge of the side wall.

21 Claims, 12 Drawing Sheets

(51) Int. Cl.
*B65D 25/32* (2006.01)
*B65D 43/02* (2006.01)
*B65D 21/02* (2006.01)
*B65D 25/14* (2006.01)
*B65D 53/00* (2006.01)

(52) U.S. Cl.
CPC ..... *B65D 25/14* (2013.01); *B65D 25/16* (2013.01); *B65D 25/32* (2013.01); *B65D 43/0208* (2013.01); *B65D 43/0212* (2013.01); *B65D 43/0216* (2013.01); *B65D 53/00* (2013.01); *B65D 2543/0024* (2013.01); *B65D 2543/00037* (2013.01); *B65D 2543/0074* (2013.01); *B65D 2543/00092* (2013.01); *B65D 2543/00101* (2013.01); *B65D 2543/00194* (2013.01); *B65D 2543/00268* (2013.01); *B65D 2543/00296* (2013.01); *B65D 2543/00435* (2013.01); *B65D 2543/00462* (2013.01); *B65D 2543/00518* (2013.01); *B65D 2543/00537* (2013.01); *B65D 2543/00555* (2013.01); *B65D 2543/00564* (2013.01); *B65D 2543/00629* (2013.01); *B65D 2543/00657* (2013.01); *B65D 2543/00685* (2013.01); *B65D 2543/00768* (2013.01); *B65D 2543/00796* (2013.01); *B65D 2543/00842* (2013.01); *B65D 2565/385* (2013.01)

(58) Field of Classification Search
CPC ..... B65D 43/0216; B65D 25/16; B65D 2543/00092; B65D 2543/00555; B65D 2543/00657; B65D 2543/00768; B65D 2543/00101; B65D 2543/00; B65D 2543/00435; B65D 2543/00296; B65D 2543/0024; B65D 2543/00564; B65D 2543/0074; B65D 2543/00796; B65D 2543/00842; B65D 2565/385; B65D 2543/00629
USPC ..... 220/495.01–495.11, 203.09, 221, 220/639–659, 4.01–4.34, 6–8
See application file for complete search history.

(56) References Cited

U.S. PATENT DOCUMENTS 4,122,973 A * 10/1978 Ahern ..... B05C 21/00 220/495.02
4,182,475 A 1/1980 Freund
4,192,434 A 3/1980 Conroy
4,765,579 A * 8/1988 Robbins, III ..... B65F 1/06 220/495.04
4,917,263 A * 4/1990 Korb ..... B65F 1/06 220/495.09
5,072,852 A * 12/1991 Smith ..... B30B 9/321 100/226
5,167,343 A * 12/1992 Winfrey ..... B65F 1/0046 100/102
5,538,153 A 7/1996 Marovskis et al.
5,988,190 A * 11/1999 Borges ..... B08B 3/044 134/104.4
6,378,721 B1 * 4/2002 Williams ..... B65F 1/0006 220/495.08
7,565,985 B2 * 7/2009 Lucey ..... B44D 3/12 220/23.87
8,499,946 B2 * 8/2013 Giles ..... A61J 9/001 215/11.1
2006/0201946 A1 9/2006 Witt
2006/0261067 A1 11/2006 Letica
2013/0206763 A1 8/2013 Sinn et al.
2014/0183198 A1 7/2014 Slack
2014/0209618 A1 7/2014 Slack
2016/0272388 A1 9/2016 Slack

FOREIGN PATENT DOCUMENTS

DE 10 2012 109 559 4/2014
EP 0 662 426 7/1995
EP 3068705 9/2016
GB 1 507 587 4/1978
GB 2492887 1/2013
RU 2531265 10/2014
WO 96/19388 6/1996
WO 2005/051792 6/2005
WO 2006/089432 8/2006
WO 2007/065232 6/2007
WO 2010/150985 12/2010
WO 2012/107212 8/2012
WO 2013/036820 3/2013
WO 2015/071664 5/2015

OTHER PUBLICATIONS

U.S. Office Action dated Jul. 26, 2018 in U.S. Appl. No. 15/034,941 and the Notice of References Cited, 16 pages.
International Search Report and Written Opinion of the International Searching Authority for the International Stage of the present National Phase entry (PCT/GB2015/053411) dated Feb. 4, 2016, 10 pages.
UK Examination Report for an application (GB1508134.2) from which the present application claims priority dated Mar. 3, 2017, 6 pages.
International Search Report and Written Opinion of the International Searching Authority (PCT/GB2014/053361) from which the present application claims priority dated Feb. 10, 2015, 10 pages.
UK Search Report for an application (GB1320221.3) from which PCT/GB2014/053361 claimed priority dated Mar. 21, 2014, 2 pages.

* cited by examiner

RIM FOR A CONTAINER

BACKGROUND a. Field of the Invention

This invention relates to a rim assembly for a container, to a container including a rim assembly and to a method of forming a container including a rim assembly.

b. Related Art

There is a general desire and need to reduce the amount of waste that is produced and a drive to recycle as much as possible. One particular area that is receiving much attention is packaging.

Containers for hazardous liquids, such as paints, are difficult to dispose of in an environmentally safe manner and very few containers are recycled due to contamination by the paint, oil or other similar substance.

Known paint pots and similar containers filled with environmentally hazardous liquids are typically made from a semi-rigid plastics material or from metal. After use, the pot remains contaminated with paint residue or similar and the entire container must be disposed of in a suitable manner depending on the type of hazardous liquid. Often the containers end up in a specialist landfill. However, the cost associated with dealing with these containers means that it is becoming increasingly difficult to dispose of them in a convenient and cost effective way.

It is known to provide containers for liquids such as paint comprising a main body formed of paperboard and having an inner plastics lining, such as that described in UK patent application GB 2492887. These containers have the advantage that the contaminated plastics lining can be separated from the paperboard shell for disposal once the contents of the container have been used.

Typically, the contents of the container are not used all at one time and it is necessary, therefore, to be able to repeatedly reseal the container and prevent the liquid contents evaporating or drying between uses. It is often difficult, however, to form a good seal, i.e. a liquid-proof seal, between a container formed of paperboard or laminated paperboard and a lid if it is necessary to be able to repeatedly remove the lid from the container.

For example, it is known to seal a paper cup or container with a foil lid that is heat sealed to the rim of the container. These lids can provide a good seal; however, they are designed for single use and once they have been removed, the container cannot be resealed. It is also known to provide plastic lids that snap fit over the rolled rim of a typical paper cup or container, such as those lids that are provided with a drinking hole for disposable coffee cups. These lids can be repeatedly used to close the container; however, they do not provide a good seal. As such, any liquid contents of the container may leak out through small gaps between the rim of the container and the lid. This is especially problematic near any overlapping seams in the container due to the change in thickness of the side wall and rim in this region.

It is, therefore, an object of the present invention to provide a sealing element for a container that enables reliable and repeated sealing of the container.

SUMMARY OF THE INVENTION

According to a first aspect of the present invention there is provided a rim assembly for a container, the container comprising a main body and a lid, the main body including a side wall having a plurality of apertures and a top edge defining an opening of the container, and the rim assembly comprising:

- a frame member having a perimeter corresponding in shape to said opening of the container such that, in use, the frame member is received within the opening and extends around an interior surface of the side wall of the main body;
- a plurality of securing tabs hingedly connected to the frame member, each tab including an engagement member;
- sealing means configured for repeated sealing engagement with said lid of the container; and
- retaining means,
- wherein, in use, each of the securing tabs is movable between a first position in which the engagement member is disengaged from said aperture and a second position in which the engagement member is engaged with one of said apertures, and wherein the retaining means is configured to retain the securing tabs in the second position such that the rim assembly is secured to the main body of the container around the top edge.

Typically the tabs are spaced around and extend from a periphery of the frame member. Each of the tabs may include a channel or recess for receiving a part of the retaining means.

In preferred embodiments the securing tabs are configured such that, in use, when the tabs are in the second position each of the engagement members extends fully through the respective aperture. In some embodiments the securing tabs are configured such that when the tabs are in the second position, each of the engagement members contacts the frame member.

Preferably the rim assembly is configured such that, in use, when the securing tabs are in the second position, each of the securing tabs extends down over an exterior surface of the side wall of the main body.

To simplify manufacture the frame member, securing tabs and sealing means are preferably parts of a unitary rim element. Each of the securing tabs is preferably connected to the frame member by means of a live hinge.

The retaining means may be integrally formed with the securing tabs and/or the frame member or, alternatively, the retaining means may be separate from the rest of the rim assembly. In some preferred embodiments, the retaining means comprises a strap. The retaining means may comprise a band or tape.

Each of the securing tabs preferably has a first surface and a second surface. In these embodiments the engagement member extends from the first surface and, in use, when the securing tabs are in the second position the retaining means is in contact with the second surface of each of the tabs.

Typically the sealing means and the securing tabs will be provided on opposite sides of the frame member.

To allow the rim assembly to be fitted to a cylindrical container the frame member is preferably in the form of an annular member.

The rim assembly may further comprise at least two attachment members connected to the frame member for attachment of a handle to the rim assembly. The attachment means may allow a handle to be pivotally attached to the rim assembly. In some of these embodiments, when the retaining means is engaged with the securing tabs to retain said tabs in the second position, the point of attachment of the handle to each of the attachment members is further below the top edge of the container than the retaining means.

To allow the rim assembly to be easily removed from the main body of the container after use, the hinged connection between each of the securing tabs and the frame member is preferably biased such that, in use, when the retaining means is removed the securing tabs are urged to move from the second position to the first position.

According to a second aspect of the present invention there is provided a main body of a container comprising:

a base;

a side wall extending upwards from the base around a full periphery of the base, a top edge of the side wall defining an opening of the container; and a plurality of apertures in the side wall proximate the top edge, the apertures being spaced apart around the side wall.

In preferred embodiments the apertures are elongate and a long dimension of each aperture extends substantially parallel to the top edge of the side wall.

According to a third aspect of the present invention there is provided a container comprising:

a main body including a base and a side wall, the side wall having a top edge defining an opening of the container and a plurality of apertures;

a lid for covering the opening; and a rim assembly comprising:

a frame member that extends around an interior surface of the side wall of the main body below the top edge;

sealing means configured for repeated sealing engagement with the lid;

a plurality of securing tabs hingedly connected to the frame member, each tab including an engagement member, the engagement member of each tab being engaged with a respective one of the apertures; and retaining means configured to apply a force to the securing tabs to retain each engagement member in the respective aperture such that the rim assembly is secured to the main body around the top edge.

The retaining means preferably comprises a strap that extends around and applies a force to all of the securing tabs.

To simplify manufacture the frame member, securing tabs and sealing means are preferably parts of a unitary rim element. Typically the rim element is made of a relatively rigid plastics material.

In preferred embodiments the main body of the container is made of a paperboard material. The container may further comprise a lining formed of a flexible, thin film plastics material. In these embodiments the lining may be secured to the frame member of the rim assembly and the lining may extend over and cover internal surfaces of the main body. The lining is preferably securely bonded to the frame member of the rim assembly and the lining is preferably lightly adhered to the internal surfaces of the main body, such that, in use, the rim assembly and lining may be fully separated from the main body of the container.

In preferred embodiments the container further comprises a handle connected to the frame member of the rim assembly by means of attachment members located on an exterior side of the side wall of the main body.

The container may be for storing at least one of paint, varnish, woodcare liquid, adhesive, filler and putty.

According to a fourth aspect of the present invention there is provided a method of constructing a container, the container comprising a main body including a base and a side wall, the side wall having a top edge defining an opening of the container and a plurality of apertures formed in the side wall, and a rim assembly, and the method comprising:

inserting a frame member of the rim assembly through the opening so that the frame member extends around an interior surface of the side wall of the main body;

moving a plurality of securing tabs of the rim assembly from a first position in which the securing tabs are not engaged with the side wall of the main body to a second position in which an engagement member of each of the securing tabs is engaged with one of said apertures; and retaining the securing tabs in the second position by means of a retaining strap configured to apply a force to each of the securing tabs, such that the rim assembly is secured to the main body of the container around the top edge.

Typically the container further comprises a lid for covering the opening, and the method preferably comprises engaging the lid with a sealing means of the rim assembly, the sealing means being configured for repeated sealing engagement with the lid of the container.

The container may further comprise a lining covering interior surfaces of the main body, and the method preferably comprises:

securely bonding the lining to the frame member of the rim assembly, and lightly adhering the lining to the internal surfaces of the main body, such that, in use, the rim assembly and lining may be fully separated from the main body of the container.

The method may further comprise attaching a handle to the rim assembly.

BRIEF DESCRIPTION OF THE DRAWINGS

The invention will now be further described by way of example only and with reference to the accompanying drawings, in which.

DETAILED DESCRIPTION

Figure 1:
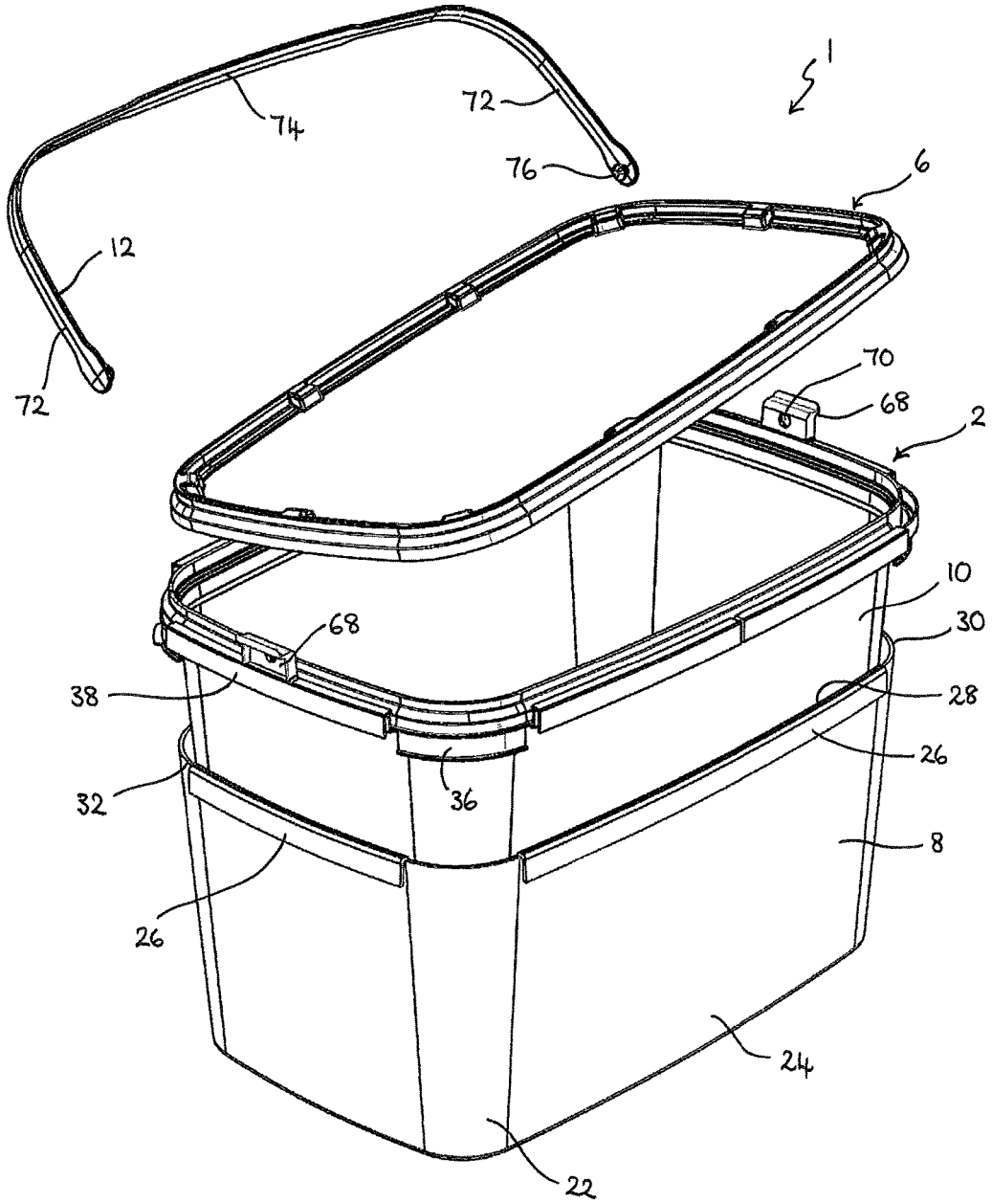
FIG. 1 is a perspective, exploded view of a first example of a container including a rim element.
Figure 2:
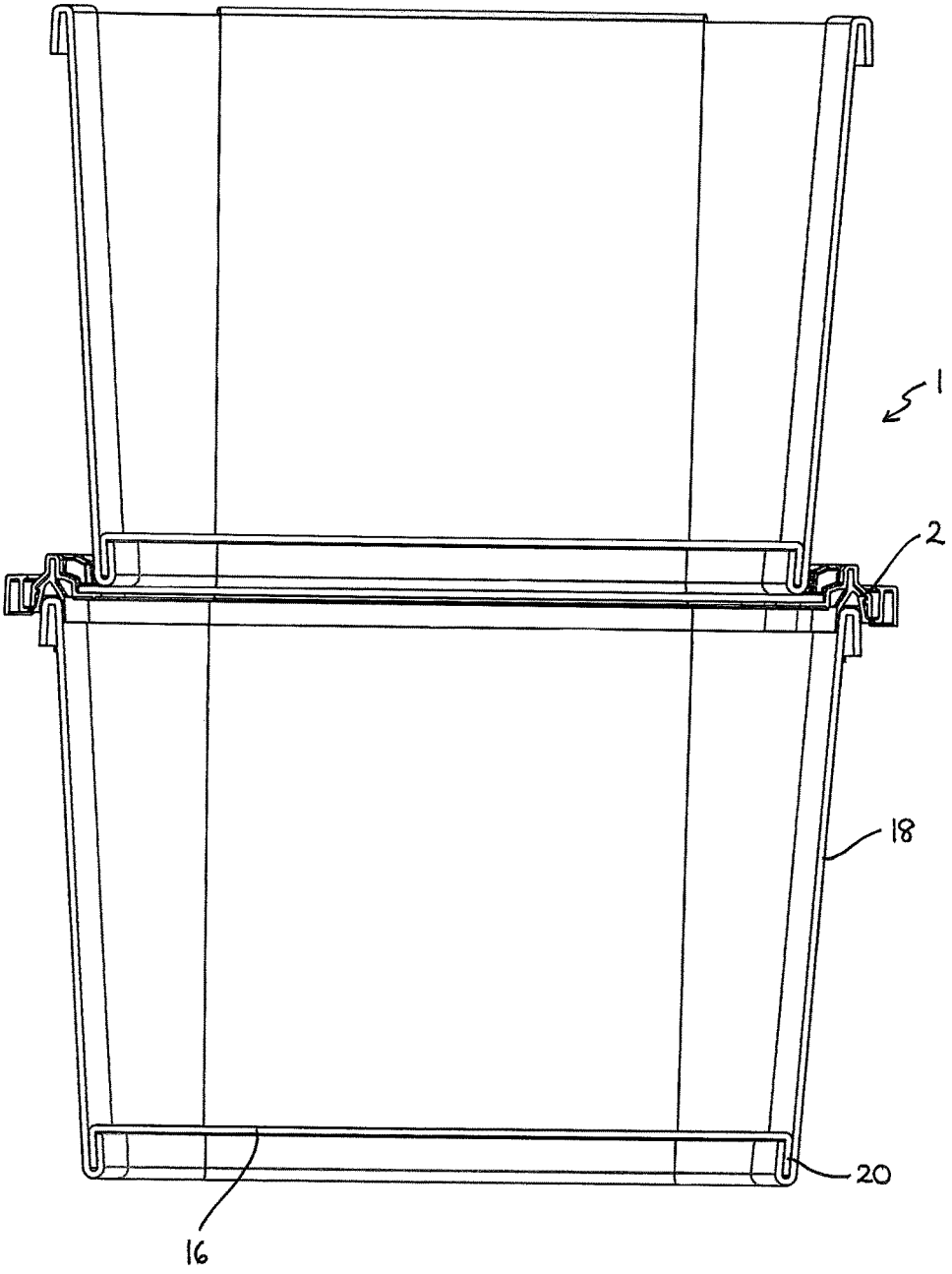
FIG. 2 is a vertical cross-sectional view of a pair of stacked containers, the containers being only partially assembled.
Figure 7:
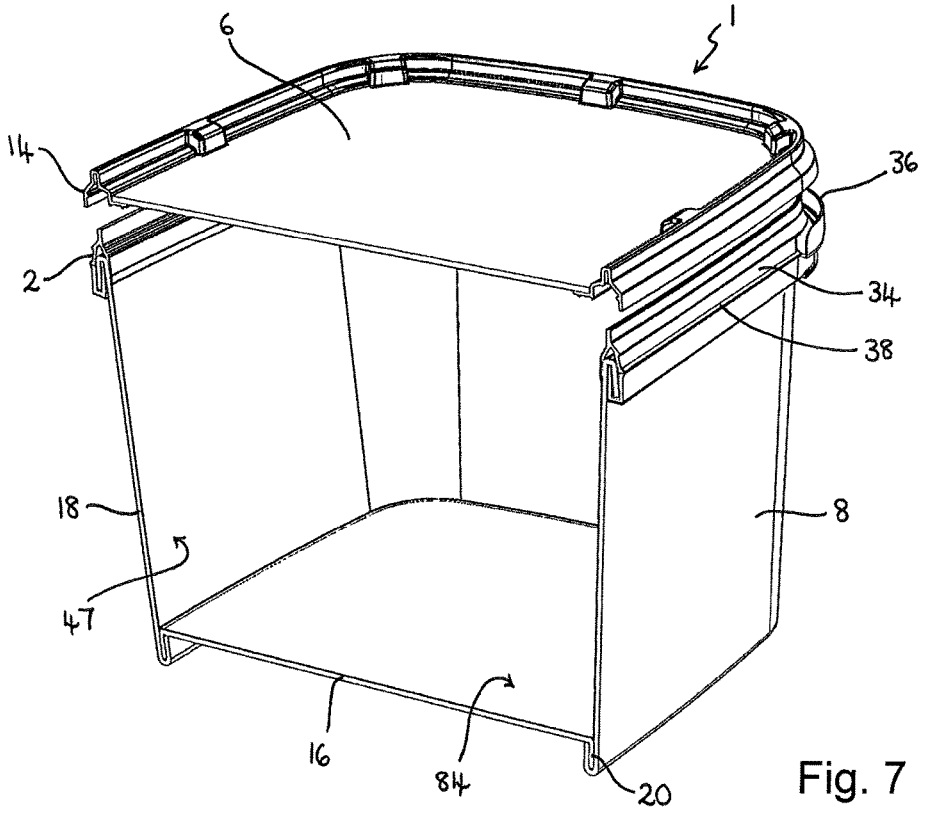
FIG. 7 is a cut away perspective view of the container of FIG. 1 in which the container is fully assembled and the lid has been removed.
Figure 8:
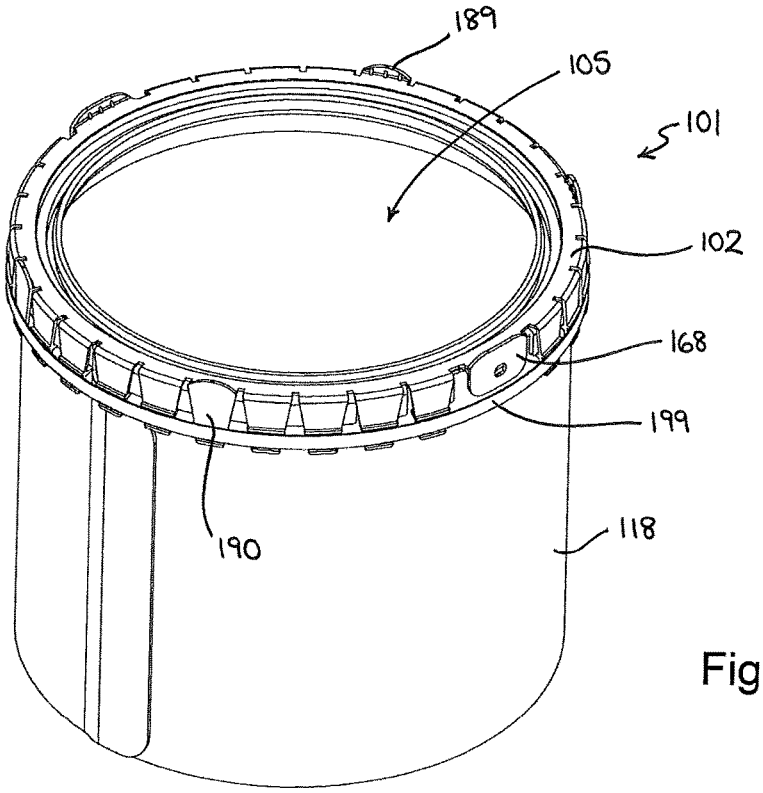
FIG. 8 is a perspective view from above of a second example of a container including a rim element.
Figure 9:
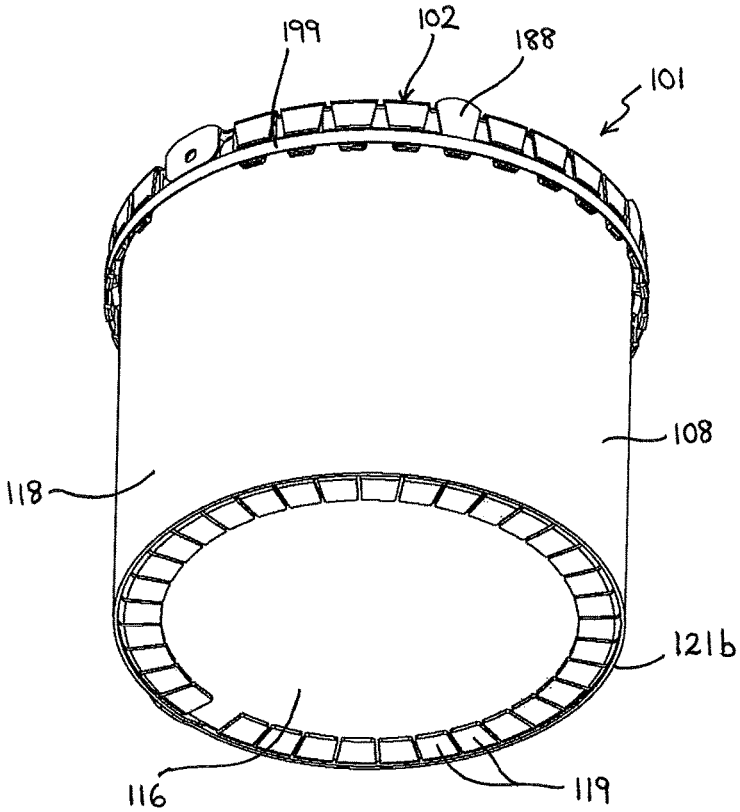
FIG. 9 is a perspective view from below of the container of FIG. 8.

FIGS. 1, 2 and 7 illustrate a first example of a container 1 comprising a rim element 2. The container 1 includes a main body or outer shell 8, a lid 6, an inner lining 10 and the rim element 2. Preferably the main body or outer shell 8 is made from a paperboard material, the inner lining 10 is made from a thin film plastics material and the rim element 2 is made from a plastics material. In this example the container 1 also comprises a handle 12 (shown in FIG. 1).

The rim element 2 is designed to engage with a complementary sealing element 14 on the lid 6 in such a way as to enable repeated engagement and disengagement of the lid 6 with the main body 8 of the container 1. This allows the container 1 to be opened, some of the contents to be removed and the container 1 to be resealed in a reliable manner. Furthermore, the seal that is formed between the rim element 2 and the lid 6 is such that any liquid contents of the container 1 cannot leak from the container.

FIG. 1 shows a container 1 in the form of a paint pot or other similar container that may hold liquid or semi-liquid products, for example paint or varnish. The container may also be used to hold other products such as pastes, e.g. grout, or colloidal suspensions, e.g. hand creams. The container may be designed to contain and store hazardous or non-hazardous products such as paints, cleaning products, cosmetics and foodstuffs.

The outer shell 8 of the container 1 is made from a suitable paperboard or cardboard material with no wax or plastics coating or lamination. The shell 8 comprises a base 16 and a side wall 18, the side wall 18 extending fully around the periphery of the base 16 and extending upwards from the base. The base 16 and side wall 18 thereby define an interior volume of the main body of the container 1, as shown most clearly in FIGS. 2 and 7.

The outer shell 8 is made from sheet paperboard that has been folded and glued to form the final shape of the shell. In particular, a first sheet of paperboard is cut and folded to form the base 16 of the shell 8, and a second sheet of paperboard is cut and folded to form the side wall 18 of the shell 8. The base 16 is adhered to the side wall 18 around a bottom edge 20 of the container 1.

Figure 3:
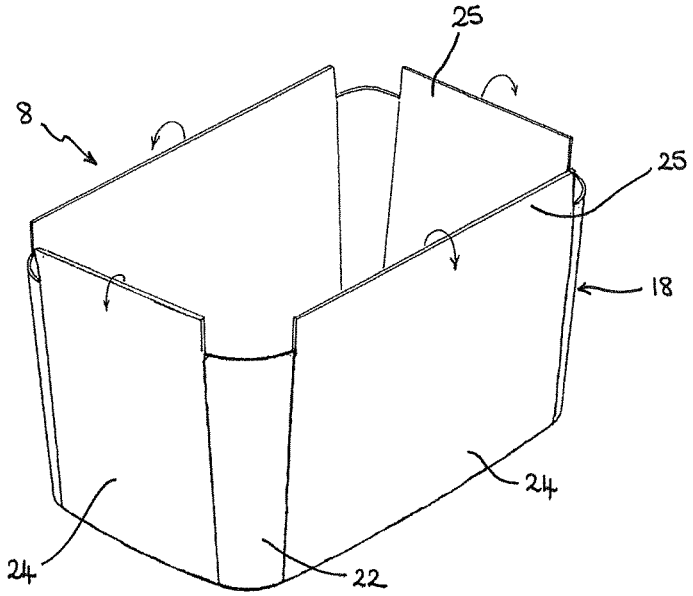
FIG. 3 is a perspective view of an outer shell of a main body of a container.

In this example the base 16 has a rounded rectangular shape and the side wall 18 includes curved corner panels 22 and substantially straight side panels 24. As shown in FIG. 3, the shell 8 is manufactured such that, initially, the height of each of the side panels 24 is greater than the height of each of the corner panels 22; the corner panels 22 each being of a first height and the side panels 24 each being of a second height. In this way, tab portions 25 of the side panels 24 extend upwards beyond the height of the corner panels 22.

To finish forming the shell 8 of the container 1 the tab portions 25 are folded outwards as indicated by the arrows in FIG. 3. Once folded, the tab portions 25 form skirt portions 26 that extend downwards on an exterior side of the side panels 24. The folded or curved top edge 28 of each of the skirt portions 26 preferably lies flush with a top edge 30 of each of the corner panels 22, thereby forming a continuous top edge or rim 32 of the shell 8; however, the top edge 28 of each of the side panels 24 may lie above the top edge 30 of the corner panels 22 as shown in FIG. 1.

Although in this example the outer shell 8 is made from a cardboard or paperboard material, the outer shell 8 may, alternatively, be made from a plastics material.

The rim element or collar 2, shown most clearly in FIGS. 4 to 7, includes an annular member 34 that attaches to and extends around the rim 32 of the shell 8 of the container 1. Accordingly, in this example, the annular member 34 is substantially non-circular, having a rounded rectangular shape comprising corner regions 36 and side regions 38.

The rim element 2 comprises a mounting portion 40, a securing portion 42 and engagement or sealing means 44. The mounting portion 40 includes a first, inner annular wall 46, and a second outer annular wall 48. The inner and outer annular walls 46, 48 are connected at their respective top edges, thereby defining a channel 50 between them that extends fully around the rim element 2. When the rim element 2 is secured to the shell 8, the element 2 is seated over the rim 32 of the shell 8 so that inner annular wall 46 extends downwards over an interior surface 47 of the side wall 18 of the shell 8, the second outer annular wall 48 extends downwards around an exterior of the shell 8, and the rim 32 of the shell 8 is positioned within the channel 50.

In this example a first part of the engagement or sealing means 44, in the form of a rail member 52, extends upwards from the mounting portion 40. The rail member 52 extends continuously around the rim element 2. A second part of the engagement means 44, in the form of a rib or barb 54, projects from an outer surface of the outer annular wall 48 of the mounting portion 40. The engagement means 44 is designed to engage with a complementary sealing element 14 on the lid 6 of the container 1, as described further below.

Figure 5:
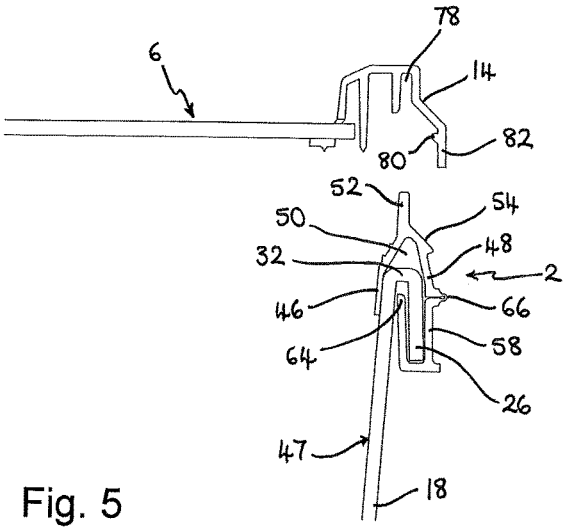
FIG. 5 is a cross-sectional detail view showing the rim element of FIG. 1 in a fully assembled state, with the lid separated from the body of the container.

As shown most clearly in FIG. 5, the arrangement of the rail member 52 and the inner and outer annular walls 46, 48 is such that a vertical cross-section through the mounting portion 40 and engagement means 44 is substantially wishbone-shaped.

In this example, the securing portion 42 is connected to the outer annular wall 48 of the mounting portion 40. The securing portion 42 is arranged to engage with the skirt portion 26 of the shell 8 to secure the rim element 2 to the shell 8. The securing portion 42 comprises a substantially U-shaped channel member 56 having two parallel arm members 58, 60 that extend along the length of the channel member 56 and a base member 62 connecting the two arm members 58, 60, such that an opening 63 is defined between the arm members 58, 60. An edge of a first one of the arm members 58 is hingedly connected to the outer annular wall 48 of the mounting portion 40. An edge 64 of the other one of the arm members 60 is a free edge 64.

In this example the annular member 34 of the rim element 2 is a unitary member and the arm member 58 is hingedly connected to the outer annular wall 48 by a natural or live hinge 66 formed in the plastics material of the rim element 2. It will be appreciated, however, that the hinged connection may be formed in any other suitable way. The connection between the mounting portion 40 and the securing portion 42 may be made in any suitable way that enables pivoting or rotation of the securing portion 42 with respect to the mounting portion 40.

Figure 4:
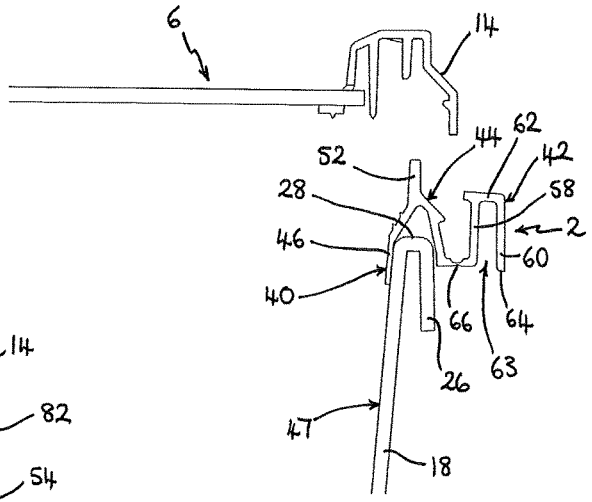
FIG. 4 is a cross-sectional detail view showing the rim element of FIG. 1 in a partially assembled state.

The hinged connection enables the securing portion 42 of the rim element 2 to rotate with respect to the mounting portion 40 between a disengaged position, shown most clearly in FIG. 4, and an engaged position, shown most clearly in FIG. 5. In the disengaged position the securing portion 42 is positioned on an external side of the mounting portion 40, with the channel 50 of the mounting portion 40 and the opening 63 of the securing portion 42 oriented in the same direction. In the engaged position, the securing portion is 42 is positioned below the mounting portion 40 so that the channel 50 of the mounting portion 40 and the opening 63 of the securing portion 42 are oriented in opposite directions. Furthermore, in this engaged position the arm member 58 is substantially continuous with the outer annular wall 48 of the mounting portion 40, and the free edge 64 of the arm member 60 is located between the inner and outer annular walls 46, 48.

To secure the rim element 2 to the outer shell 8, the mounting portion 40 is pressed over the top edge 28 of each of the skirt portions 26. The securing portion 42 is then moved from the disengaged position to the engaged position such that the channel member 56 locates around and under the skirt portion. In the engaged position, the skirt portion 26 of the shell 8 is located in the opening 63 of the securing portion 42 and the arm member 60 is located between the side panel 24 and the skirt portion 26 of the shell 8.

As shown in FIG. 1, separate skirt portions 26 are formed along each of the side panels 24 of the shell 8 and separate securing portions 42 are formed along each of the side regions 38 of the annular member 34. Once all of the securing portions 42 have been moved into their engaged position and engaged with the respective skirt portion 26, the rim element 2 is then, preferably, fully secured to the shell 8 using suitable retaining means.

The retaining means is preferably in the form of a length of adhesive tape (not shown) that is placed fully around the rim element 2 in contact with the outer annular wall 48 and all of the arm members 58. With the tape adhered to the rim element 2 in this way, the securing portions 42 are then unable to move out of their engaged positions back to the disengaged positions without first removing the retaining means.

In this example, the rim element 2 further comprises attachment means 68 in the form of a pair of mounting tabs or brackets 68 to which the handle 12 may be attached. As shown in FIG. 1, the mounting tabs 68 are positioned centrally along opposing side regions of the annular member 34. Each of the mounting tabs 68 includes a hole 70 for engagement with a part of the handle 12.

The handle 12 is substantially U-shaped and is formed of a suitable plastics material. Preferably the handle 12 is made of the same plastics material as the rim element 2. The handle 12 includes two arm portions 72, one extending from either end of a central gripping portion 74. At a free end of each of the arm portions there is an inwardly projecting pin or trunnion 76.

When the handle 12 is attached to the main body 4 of the container 1, each of the trunnions 76 locates in a respective one of the holes 70 in the mounting tabs 68 of the rim element 2. In this way, a pivotal connection is made between the handle 12 and the main body 8 of the container 1.

When a user lifts the container 1 by the handle 12, an upward force is exerted on the rim element 2, which tries to pull the rim element 2 off the top of the side wall 18 of the shell 8. However, because the securing portion 42 of the rim element 2 is engaged with the skirt portion 26, and in particular because the arm member 60 is located between the side panel 24 and the skirt portion 26 of the shell 8, the rim element 2 cannot be pulled upwards relative to the shell 8, and the rim element remains securely attached to the shell 8.

Figure 6:
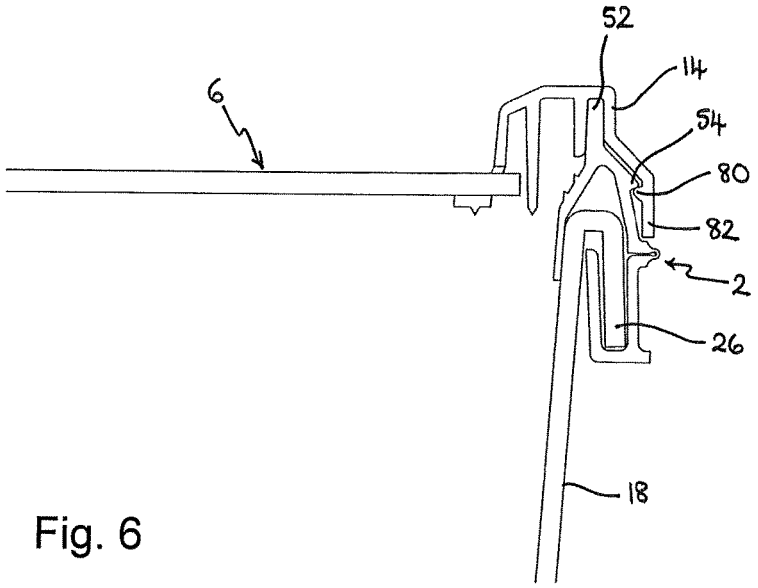
FIG. 6 is a cross-sectional detail view showing the rim element of FIG. 1 in a fully assembled state, with the lid connected to the body of the container.

As shown most clearly in FIGS. 5 and 6, the lid 6 includes a sealing element 14 that engages with the engagement means 44 of the rim element 2 when the lid 6 is placed onto the main body 4 of the container. In this example, the sealing element 14 of the lid 6 comprises a channel portion 78 that is sized to receive the rail member 52, and an inwardly extending projection or barb 80 on an internal surface of an outer side wall 82.

When the sealing element 14 of the lid 6 is pressed down over the rim element 2 of the main body, there is a push fit of the rail member 52 into the channel portion 78, and the outer side wall 82 extends down over the outer annular wall 48. The outer side wall 82 is able to resiliently flex such that the barb 80 of the sealing element 14 engages with the barb 54 of the rim element 2 to retain the lid 6 on the main body 8, as shown in FIG. 6.

The lid 6 can be removed from the main body 8 by flexing the outer side wall 82 to disengage the barbs 54, 80 and then pulling the lid 6 in an upwards direction to remove the rail member 52 from the channel portion 78.

Because both the rim element 2 and sealing element 14 are formed from a suitable plastics material, the engagement and seal between the rim element 2 and sealing element 14 can be repeatedly formed during use of the container 1.

In preferred examples, the main body of the container includes an inner lining 10 made from a thin film plastics material, shown in FIG. 1. This lining 10 acts as a barrier layer preventing leaking of the contents of the container 1 through the paperboard shell 8. The barrier properties of the lining 10 may additionally prevent moisture or gasses entering or leaving the container 1 which may spoil or degrade the contents of the container 1.

Considering paints in particular, water-based paints are typically flushed with formaldehyde, or a similar substance, immediately before being sealed within a container to prevent the growth of fungus or bacteria in the paint. Similarly, it is necessary to prevent the evaporation of volatile additives from oil-based paints. In both these example, therefore, the barrier properties of the lining 10 must be tailored to prevent gas permeation through the lining 10.

In this example the lining 10 is made from thin-film polyethylene; however, the lining 10 may be made from any suitable thin-film plastics material. In particular, it may be preferable if the lining 10 is a laminate formed of a number of plastics materials. These laminates may include a gas barrier material such as EVOH that will, amongst other things, prevent paint odours being released from the container 1. The laminates may additionally or alternatively include a nylon layer which provides tear resistance. Preferably the thickness of the lining 10 is less than 200 μm, and more particularly around 100 μm. The thinner the lining 10 the lower the cost of materials and the less waste that is formed. However, the lining 10 should be thick enough that it does not tear during the manufacturing process or during use of the container 1, e.g. when the contents are being stirred, and in particular during removal of the lining 10 from the shell 8, as described below.

In preferred examples, the lining 10 is inserted into and secured to the shell 8 of the container 1 after the rim element 2 has been secured to the rim 32. In particular, once the mounting portion 40 of the rim element 2 has been fitted over the rim 32 of the shell 8, a pre-formed lining 10 that at least substantially conforms to the internal shape of the shell 8 is then positioned within the interior of the shell 8, and subsequently the lining 10 is adhered to the internal surfaces 47 of the side wall of the shell 8, an internal surface 84 of the base 16 of the shell 8 and the inner annular wall 46 of the rim element 2.

Preferably the lining 10 is secured to the shell 8 and the rim element 2 using a suitable adhesive. The adhesive should have a low peel strength but a moderate shear strength, similar to the adhesive used on Post-It® Notes. The moderate shear strength of the adhesive means that the thin-film lining 10 will remain adhered to the internal surfaces 47, 84 of the outer shell 8 during use of the container 1. Additionally, because the containers 1 may be nested during transportation or storage before filling, it is important that, when the nested containers 1 are separated from each other, the lining 10 does not get pulled away from the outer shell 8. In contrast, the low peel strength means that minimal force is required to peel the lining 10 away from the outer shell 8 after use, in order to dispose of and recycle the lining 10 and the outer shell 8 separately. Preferably the peel strength of the adhesive use to bond the lining 10 to the shell 8 is less than 0.05 N, and more preferably between 0.02 N and 0.04 N.

The adhesive is preferably heat activated. The use of a heat activated adhesive means that the adhesive is only tacky when heated above a certain temperature. In this way, the lining 10 may be inserted into the shell 8 in a non-activated state in which the adhesive is not tacky. Once the lining 10 is correctly positioned within the shell 8, heat is then applied to increase the temperature and cause activation of the adhesive. The activated adhesive, which is tacky, then adheres the lining 10 to the internal surfaces 47, 84 of the shell 8 and the inner annular wall 46 of the rim element 2.

In other examples the adhesive may be pressure activated. As such, the adhesive only becomes tacky once a sufficient pressure has been applied to it. In yet other examples the adhesive may be pressure and heat activated.

The advantage of using an activated adhesive is that neither the internal surfaces 84 of the shell 8 nor external surfaces of the lining 10 are tacky when the lining is inserted into the shell 8. This allows the lining 10 to be positioned, and re-positioned, exactly as desired before the lining 10 is finally adhered to the shell 8. In particular it allows the lining to be positioned against the internal surfaces 84 of the shell 8 so that there are no wrinkles or creases in the lining 10.

In preferred examples the lining 10 is more securely adhered or bonded to the rim element 2 than to the internal surfaces 84 of the shell 8. More securely bonding the lining 10 to the rim element 2 enables the rim element 2 and the lining 10 to be separated from the shell 8 without the lining 10 separating from the rim element 2, as described further below.

Because the lining 10 is secured to the rim element 2, a complete layer of plastics material is provided covering the internal surfaces 47, 84 of the shell 8 and extending over the rim 32 of the shell 8, thereby protecting the paperboard shell 8 from the contents of the container 1.

Once the lining 10 has been secured in the shell 8, the securing portions 42 of the rim element 2 are engaged with the skirt portions 26 and the retaining means is placed around the rim element 2, as described above. In other examples, the securing portions 42 of the rim element 2 may be engaged with the skirt portions 26 before the lining 10 is secured within the shell 8.

When a user wishes to dispose of the container 1, he or she can separate the plastics rim element 2 and lining 10 from the paperboard shell 8 to enable these to be disposed of or recycled separately. To do this a user firstly removes the retaining means from around the rim element 2. The securing portions 42 are then unclipped from the skirt portions 26 and the rim element 2 is pulled upwards to disengage the rim 32 of the shell 8 from the mounting portion 40. The relatively low peel strength of the adhesive used to adhere the lining 10 to the internal surfaces 47, 84 of the shell 8 allows the lining 10 to be separated from the shell 8 as the rim element 2 is removed, such that the rim element 2 and lining 10 are removed together as a single piece. This allows the plastics and paperboard parts of the container 1 to be disposed of or recycled separately.

The outer shell may be made from a plastics material and an inner lining may be provided to prevent the contents of the container 1 from contaminating the shell. The construction of the container therefore enables the rim element and lining, which have been contaminated, to be easily separated from the uncontaminated shell of the container.

In some cases, the rim element 2 and the lining 10 may be removed from the shell 8 separately.

FIGS. 8 to 14 illustrate a second example of a container 101 comprising a rim element 102. This container 101 includes many features that are the same as or comparable to features of the container 1 of the first example described above. Similar features have been indicated by reference numerals incremented by 100.

A main body or outer shell 108 of the container 101 is made from a suitable paperboard or cardboard material with no wax or plastics coating or lamination. The shell 108 comprises a substantially circular base 116 and a side wall 118, the side wall 118 extending fully around the periphery of the base 116 and extending upwards from the base.

Figure 12:
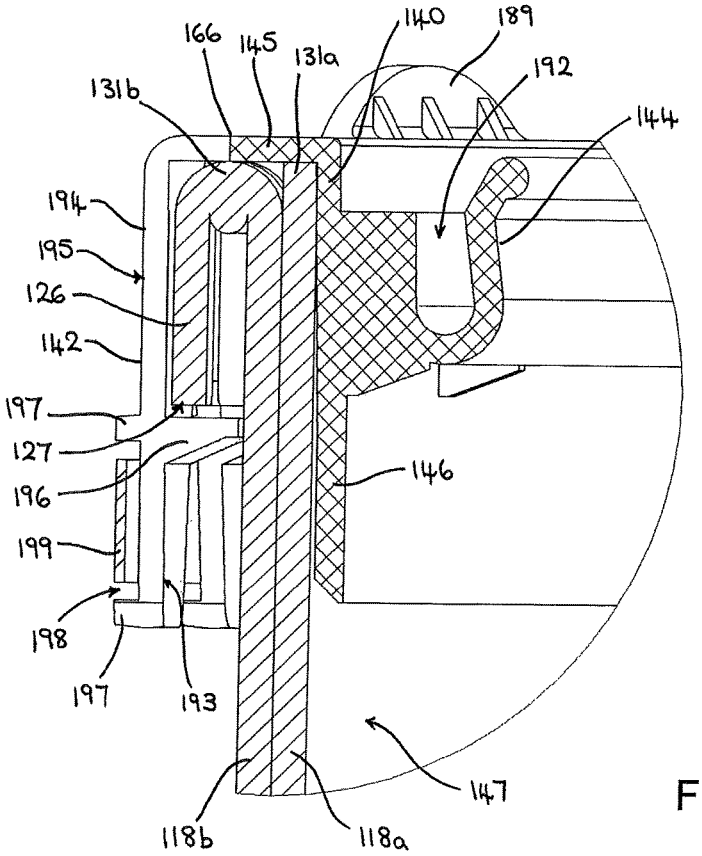
FIG. 12 is an enlarged view of a part of FIG. 11 indicated by a dashed circle.
Figure 13:
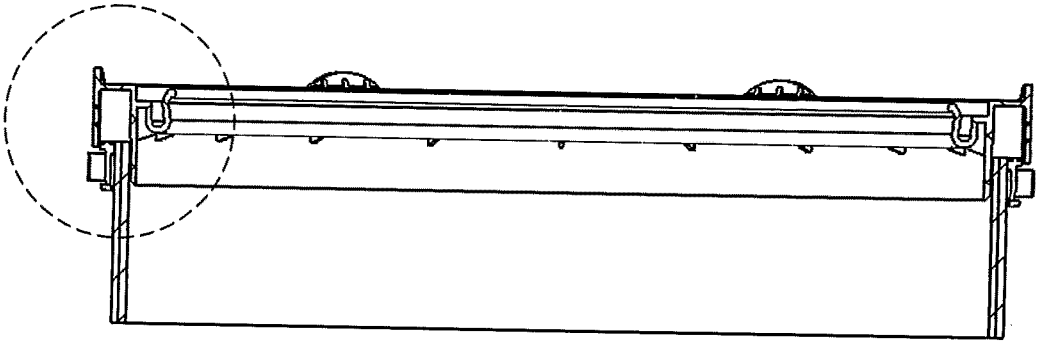
FIG. 13 is a cross-sectional view of a top region of the container of FIG. 8 showing a lining of the container and the rim element in a second, secured configuration and illustrating, in particular, a handle region of the rim element.

In this example the shell 108 comprises an inner side wall 118*a* and an outer side wall 118*b* in contact with each other, as shown most clearly in FIG. 12. The outer side wall 118*b* is substantially cylindrical and extends between a top edge 131*b* and a bottom edge 121*b*. An upper region 126 of the outer side wall 118*b* proximate the top edge 131*b* is positioned radially outwardly in relation to the rest of the outer side wall 118*b*, thereby forming a downwardly facing abutment shoulder or edge 127. This upper region 126 may be in the form of a rolled edge or a skirt portion 126 that extends downwards on an exterior side of the outer side wall 118*b*.

The inner side wall 118*a* comprises a plurality of tabs 119 extending from a bottom edge. The tabs 119 extend radially inwardly and the base 116 of the shell 108 is bonded to an upper surface of the tabs 119.

Top edges 131*a*, 131*b* of the inner and outer side walls 118*a*, 118*b* together form a rim 132 of the shell 108 that extends around and defines an opening 105 of the shell 108.

Although in this example the container 101 has inner and outer side walls 118*a*, 118*b*, it will be appreciated that the container may include a single side wall 118.

Figure 10:
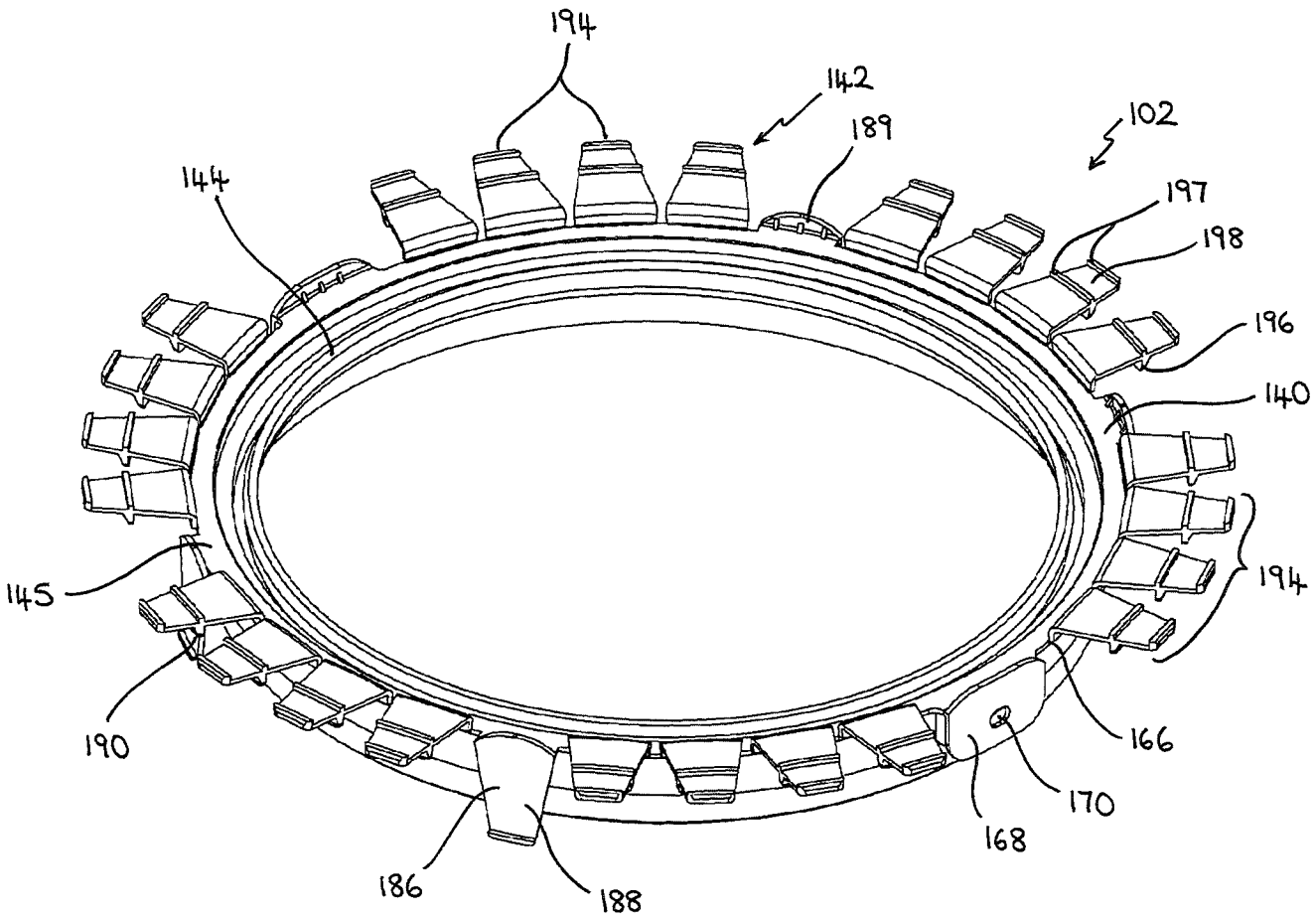
FIG. 10 shows the rim element of FIG. 8 in a first, unsecured configuration.
Figure 11:
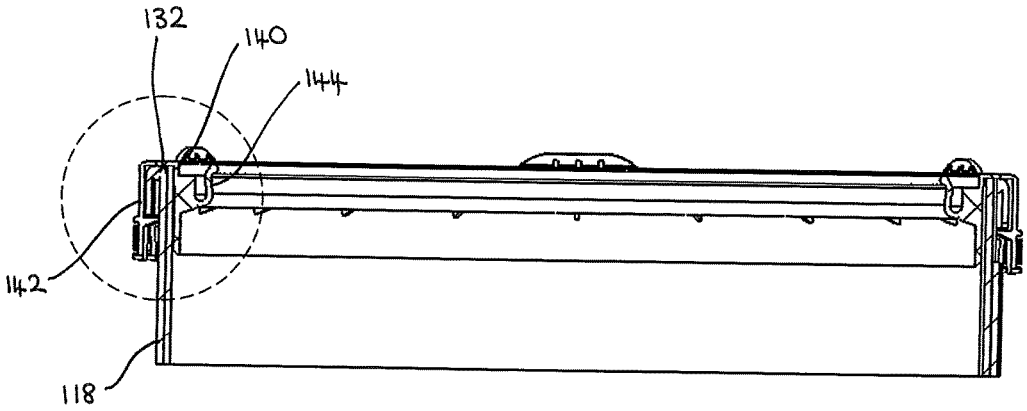
FIG. 11 is a cross-sectional view of a top region of the container of FIG. 8 showing the rim element in a second, secured configuration.

The rim element 102, shown most clearly in FIGS. 10 and 12, comprises a mounting portion 140 for mounting the rim element 102 on the rim 132 of the shell 108, a securing portion 142 for securing the rim element 102 to the side wall 118 of the shell 108, and engagement or sealing means 144 configured to releasably engage with a lid (not shown) of the container 101. Typically the rim element 102 will be made from a suitable plastics material.

The mounting portion 140 includes an annular member 134 that extends around the rim 132 of the shell 108. The annular member 134 includes a wall portion or frame member 146 that, when engaged with the shell 108 of the container 101, extends downwards over an interior surface 147 of the inner side wall 118*a*. As such, the external diameter of the wall portion 146 is substantially the same as the internal diameter of the inner side wall 118*a*. An upper edge of the wall portion 146 includes a flange or lip 145 that extends radially outwardly. This flange 145 will typically abut or be seated on the rim 132 of the shell 108 when the mounting portion 140 is fully engaged with the shell.

The mounting portion 140 further comprises stacking members 186 connected to a radially outer edge of the flange 145. Each of the stacking members 186 comprises a plate member 188 extending substantially perpendicularly to the flange 145. The plate member 188 has a first portion 189 extending upwards from the flange 145 and a second portion 190 extending downwards from the flange 145. The second portion 190 of the plate member 188 therefore extends substantially parallel to the wall portion 146 of the annular member 134, and a gap is defined between the second portion 190 of the plate member 188 and a part of the wall portion 146. When the mounting portion 140 is engaged with the shell 108, a part of the rim 132 of the shell 108 locates in each of these gaps provided by the stacking members 186. The second portions 190 of the stacking members 186 therefore aid in retaining the mounting portion 140 in engagement with the side wall 118 of the shell 108.

The first portions 189 of the plate members 188 protrude above the rest of the annular member 134 and define a space for receiving a base of another container 101 when the containers are being stacked.

In this example four stacking members 186 are provided at spaced apart locations around the annular member 134; however, different numbers of stacking members may be provided. Generally, at least two stacking members are provided located on diametrically opposite sides of the annular member.

The sealing means 144 extends generally radially inwardly from the mounting portion 140, and includes an upward facing channel 192. The sealing means 144 is configured to engage with a complementary sealing element on the lid of the container 101 such that the lid can be repeatedly engaged and disengaged from the rest of the container 101.

In this example the securing portion 142 comprises a plurality of securing tabs 194 extending from the flange 145 of the annular member 134. The securing portion 142 is arranged to engage with the abutment shoulder 127 of the shell 108 to secure the rim element 102 to the shell 108. Each of the tabs 194 is hingedly connected to the annular member 134 at a top edge so that the securing portion 142 is movable between a first, disengaged position, shown most clearly in FIG. 10, and a second, engaged position, shown most clearly in FIG. 12.

In this example the rim element 102 is a unitary member and each of the tabs 194 is hingedly connected to the flange 145 by a natural or live hinge 166 formed in the plastics material of the rim element 102. In other examples the hinged connection may be formed in any other suitable way. In still further examples the connection between the mounting portion 140 and the securing portion 142 may be made in any suitable way that enables pivoting or rotation of the securing portion 142 with respect to the mounting portion 140.

Each of the tabs 194 comprises opposing first and second faces 193, 195. When the tab 194 is in the engaged position the second face 195 faces away from the side wall 118 of the shell 108 and the first face 193 is located radially inwardly of the second face 195 and faces towards the side wall 118 of the shell 108. A detent member 196 protrudes from the first face 193 of each of the tabs 194. The detent member 196 is located such that, when the tab 194 is in the second position, the detent member 196 extends under the abutment shoulder 127 of the shell 108. The location of the detent members 196 is, therefore, such that, when the securing portion 142 is in the second position and an upward force is applied to the rim element 102, the detent members 196 contact the abutment shoulder 127 and prevent the rim element 102 being pulled off the shell 108.

In this example each tab 194 further comprises a pair of rail members 197 extending from the second face 195. The rail members 197 are spaced apart such that a channel 198 is defined between them. The rail members 197 preferably extend substantially parallel to the top edge of the tab 194. The channel 198 between the rail members 197 is sized to receive a part of a retaining means 199, described further below.

In use, with the tabs 194 of the securing portion 142 in the first position, the annular member 134 is engaged with the rim 132 of the container 101 such that the wall portion 146 extends down over the interior surface 147 of the side wall 118 and the second portions 190 of the stacking members 186 extend down over an exterior surface of the side wall 118. Each of the tabs 194 of the securing portion 142 is then pivoted, by means of the hinge, into the second position so that the detent member 196 is located under the outwardly protruding upper region 126 of the side wall 118.

Once all of the tabs 194 are in the second position, retaining means 199 in the form of an elongate strap or band 199 is secured around the outside of the tabs 194 such that the strap or band 199 locates in the channels 198 provided on the tabs 194. The strap or band 199 is tightened, i.e. a diameter of the strap 199 is decreased, so as to apply a radially inwardly directed force to the tabs 194 to retain the tabs 194 in the second position. Locating the strap 199 in the channels 198 means that once the strap 199 has been tightened and secured, the strap 199 cannot be easily removed from around the securing portion 142 without cutting the strap 199. The retaining strap 199 may be made from a suitable plastics material or a paperboard material having sufficient strength to retain the tabs 194 in the engaged position during storage and use of the container 101.

The container 101 preferably further comprises a lining 110 that extends over and covers the interior surfaces 147 of the shell 108. The lining 110 is preferably made from a thin film plastics material and acts as a barrier layer preventing leakage of the contents of the container 101 through the paperboard shell 108. The barrier properties of the lining 110 may additionally prevent moisture or gasses entering or leaving the container which may spoil or degrade the contents of the container 101.

Figure 14:
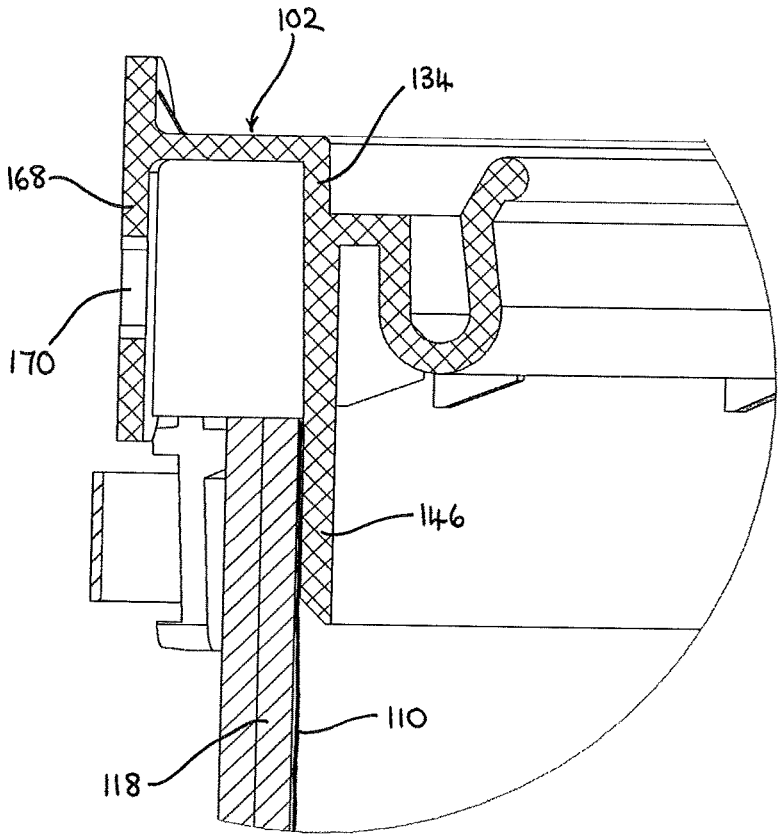
FIG. 14 is an enlarged view of a part of FIG. 13 indicated by a dashed circle.

The size and shape of the lining 110 is such that it substantially conforms to the internal shape of the shell 108. An upper edge region of the lining 110 locates between the side wall 118 of the shell 108 and the wall portion 146 of the rim element 102, as illustrated in FIG. 14. This upper edge region of the lining 110 is bonded or welded to the wall portion 146 so as to form a liquid-tight seal between the lining 110 and the rim element 102.

Typically the lining 110 will not be adhered to the side wall 118 of the shell 108, but the lining 110 may be adhered to the base 116 of the shell 108 to retain the lining 110 in the correct position with respect to the shell 108.

In these examples, once the container 101 has been used, the rim element 102 and the lining 110 may be separated from the shell 108 of the container 101 for disposal or recycling.

To remove the rim element 102 from the rim 132 of the shell 108, the retaining strap 199 is cut such that the securing tabs 194 can be moved at least partially back towards the first position. In particular each of the securing tabs 194 is moved such that the detent member 196 is withdrawn from under the protruding upper edge 126 of the shell 108. The rim element 102 can then be lifted off and away from the side wall 118 of the shell 108.

Because the lining 110 is bonded to the mounting portion 140 of the rim element 102, the lining 110 is removed together with the rim element 102. In containers in which the lining 110 is adhered to the base 116 of the shell 108, the level of adhesion is such that the lining 110 can be pulled or peeled away from the base 116 without tearing the lining 110.

In this example the rim element 102 further comprises attachment means 168 for a handle. The attachment means 168 comprises a pair of attachment plates 168 connected to the flange 145 of the mounting portion 140. Each of the attachment plates 168 includes an aperture 170 for receiving a part of an end of a handle. The attachment means 168 are preferably configured such that the handle may be pivotally attached to the rim element 102.

Figure 15:
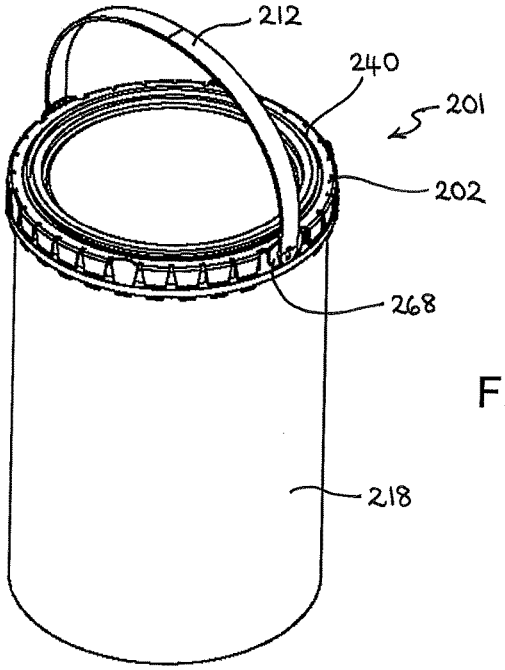
FIG. 15 is a perspective view from above of a container including a handle.

A further example of a container 201 including a handle 212 is shown in FIG. 15. The ends of the handle 212 are attached to the rim element 202 by means of attachment plates 268 positioned on diametrically opposite sides of the mounting portion 240. The handle 212 and the means of attachment of the handle 212 to the rim element 202 are substantially identical to the handle 12 and its means of attachment described above in relation to the first example of a container 1 and will not be described further here.

Figure 16:
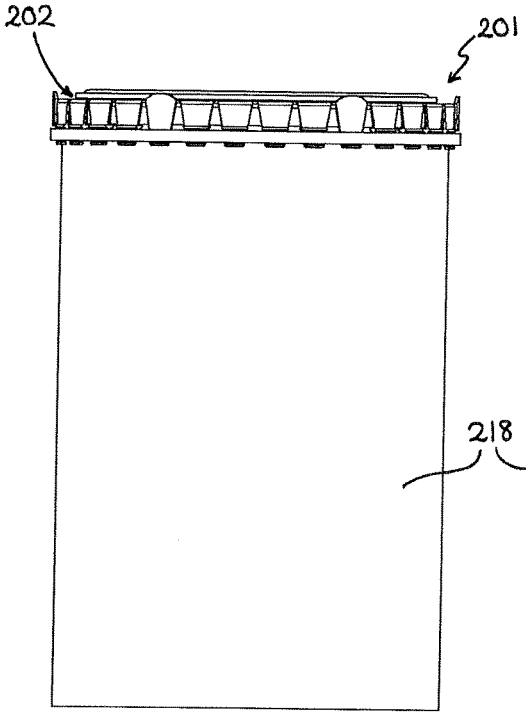
FIGS. 16 and 17 are side views of the container of FIG. 15 with the handle omitted.
Figure 17:
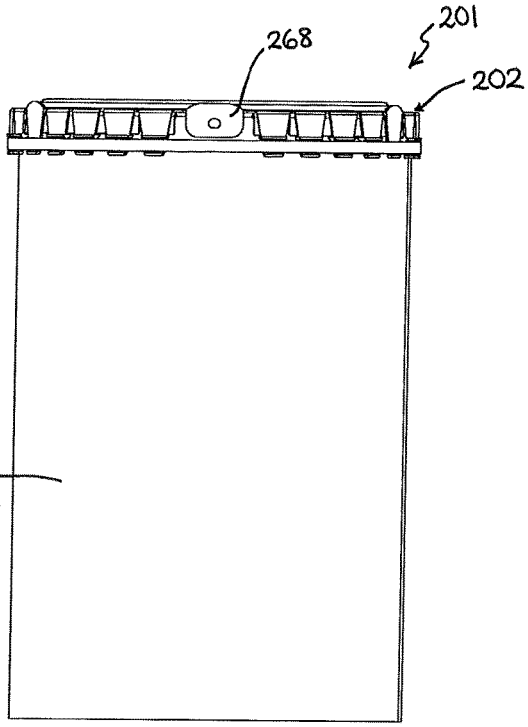

The example of the container 201 illustrated in FIGS. 15 to 17 is substantially identical to the example illustrated in FIGS. 8 to 14 except that the depth of the container 201, i.e. a height of the side wall 218, is increased to provide a larger volume container 201. The diameter of this container 201 is the same as the diameter of the smaller volume container 101 shown in FIGS. 8 to 14. This means that the same rim element 102, 202 may be used in both sizes of container. Furthermore, the two different sizes of container 101, 201 can be stacked together.

FIGS. 18 to 25 illustrate parts of a container 301 comprising a rim element 302 according to an embodiment of the present invention. This container 301 includes many features that are the same as or comparable to features of the containers of the previous examples described above and similar features have been indicated by reference numerals incremented by 100.

An outer shell or main body 308 of the container 301 is made from a suitable paperboard or cardboard material with no wax or plastics coating or lamination. The main body 308 comprises a substantially circular base and a side wall 318. The side wall 318 extends fully around the periphery of the base and extends upwards from the base. A top edge 331 of the side wall 318 extends around and defines an opening 305 of the main body 308.

A plurality of apertures 317 are formed in the side wall 318 of the main body 308 proximate the top edge 331. The apertures 317 are spaced apart and a line of apertures 317 extends around the side wall 318. In this embodiment the apertures are elongate with the long axis of each of the apertures 317 extending substantially parallel to the top edge 331.

Two notches 333 are formed in the top edge 331 of the side wall 318. The notches 333 are positioned diametrically opposite each other. In this embodiment, a depth of each of the notches 333 is greater than the distance between the apertures 317 and the top edge 331.

Figure 18:
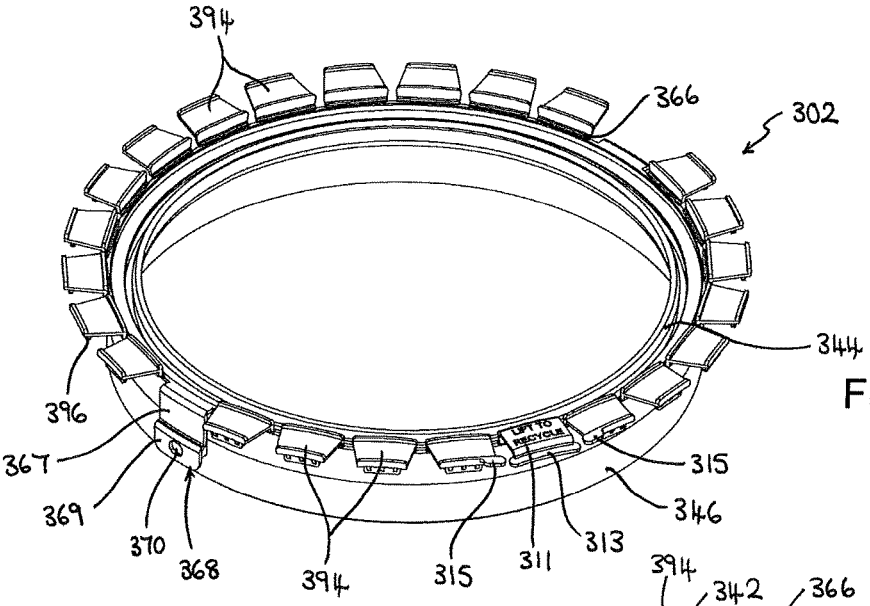
FIG. 18 is a perspective view of a rim element for a container according to a preferred embodiment of the present invention.
Figure 19:
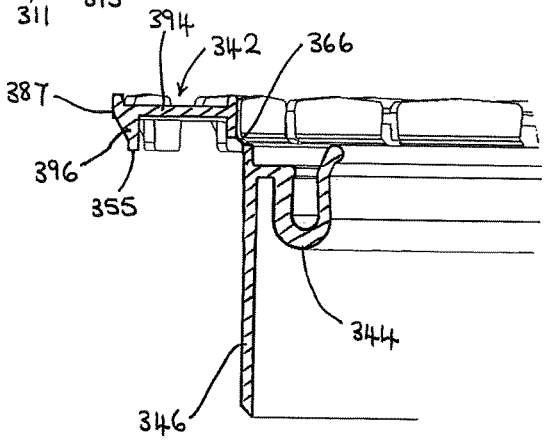
FIG. 19 is a cross-sectional detail view of the rim element of FIG. 18.
Figure 20:
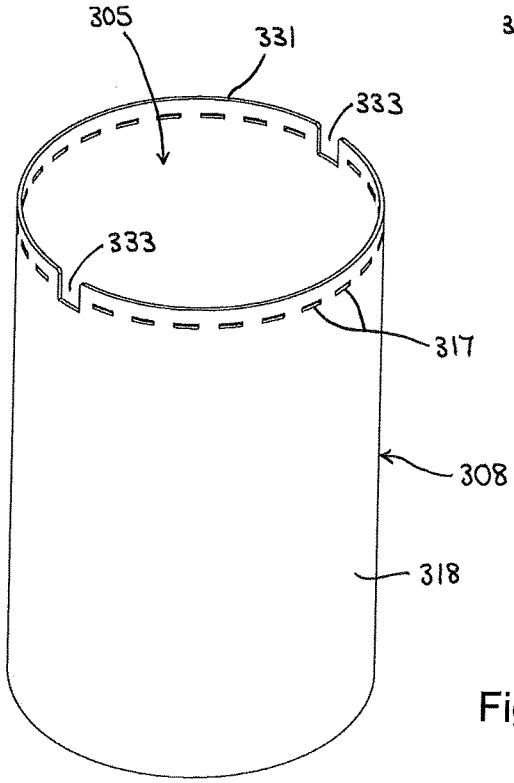
FIG. 20 is a perspective view of a main body or shell of a container according to the present invention.
Figure 21:
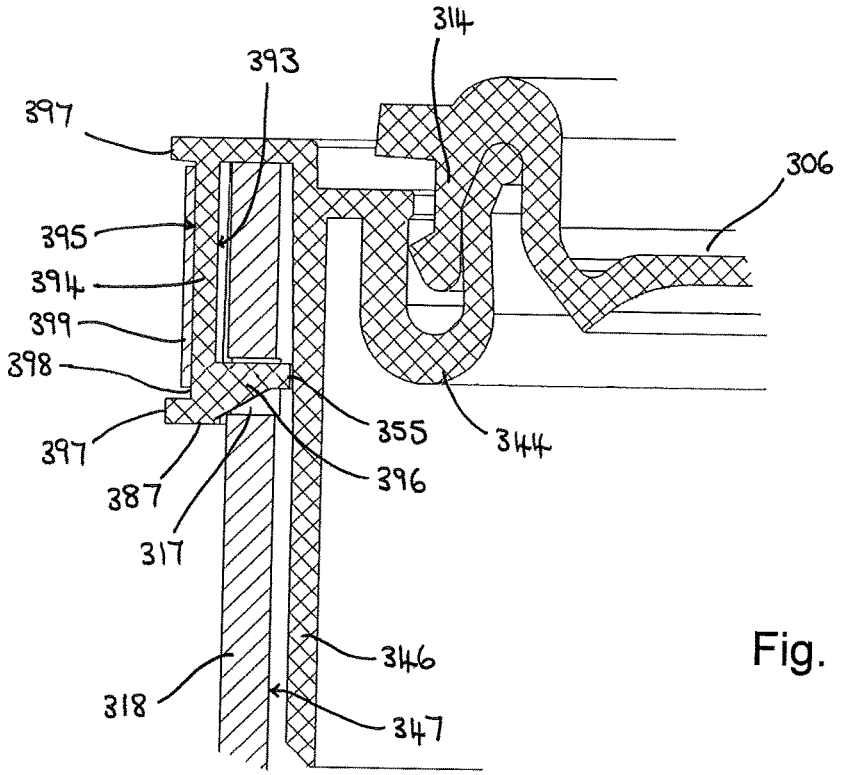
FIG. 21 is a cross-sectional detail view showing the rim element of FIG. 18 engaged with the main body of FIG. 20, and showing in particular a securing tab of the rim element engaged with an aperture in the main body.
Figure 24:
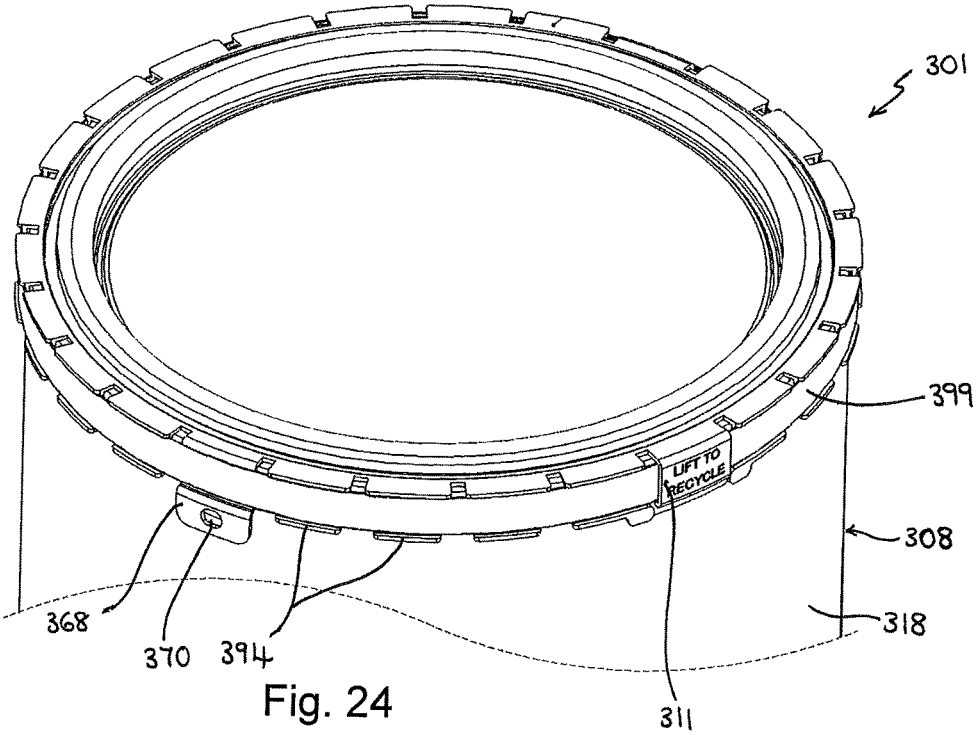
FIG. 24 is a perspective view of the assembly of FIG. 23.

The rim element 302, shown most clearly in FIGS. 18, 19 and 24, comprises a frame member 346, sealing means 344 and a securing portion 342. The rim element 302 will typically be made of a suitable substantially rigid plastics material.

In this embodiment, the rim element 302 is configured to attach to a cylindrical main body 308 and, as such, the frame member 346 is an annular member having a circular shape. The frame member 346, when engaged with the main body 308 of the container 301, extends downwards over an interior surface 347 of the side wall 118. As such, the external diameter of the frame member 346 is substantially the same as the internal diameter of the side wall 118.

The sealing means 344 of the rim element 302 is configured to engage with a complementary sealing element 314 on the lid 306 of the container 301 such that the lid 306 can be repeatedly engaged and disengaged from the rest of the container 301, as described in relation to earlier examples.

The securing portion 342 comprises a plurality of securing tabs 394 extending from an upper edge of the frame member 346. Each of the tabs 394 is hingedly connected to the frame member 346 so that the tabs 394 are movable between a first, disengaged position, shown most clearly in FIG. 18, and a second, engaged position, shown most clearly in FIG. 24.

In this embodiment the rim element 302 is a unitary element and each of the tabs 394 is hingedly connected to the frame member 346 by a natural or live hinge 366 formed in the plastics material of the sealing element 302. In other examples the hinged connection may be formed in any other suitable way. In still further embodiments the connection between the frame member 346 and the securing tabs 394 may be made in any suitable way that enables pivoting or rotation of the tabs 394 with respect to the frame member 346.

Each of the tabs 394 comprises opposing first and second faces 393, 395. When the tab 394 is in the engaged position, the first face 393 faces towards the side wall 318 of the main body 308, and the second face 395 faces away from the side wall 318 of the main body 308. An engagement or detent member 396 protrudes from the first face 393 of each of the tabs 394 proximate a distal or lower edge 387 of the tab 394. The engagement member 396 is located such that, when the tab 394 is in the second position, the engagement member 396 extends through a respective one of the apertures 317 in the main body 308, as shown most clearly in FIG. 21.

In this way, when the securing tabs 394 are in the second position and an upward force is applied to the rim element 302, the engagement members 396 prevent the rim element 302 being pulled off the top edge of the main body 308.

In this embodiment each tab 394 further comprises a pair of rail members 397 extending from the second face 395. The rail members 397 are spaced apart such that a channel 398 is defined between them. The rail members 397 preferably extend substantially parallel to the lower edge 387 of the tab 394. The channel 398 between the rail members 397 is sized to receive a part of a retaining means 399.

To secure the rim element 302 to the main body 308 of the container 301, the frame member 346 is inserted through the opening 305 such that the frame member 346 extends down over the interior surface 347 of the side wall 318. A depth of the frame member 346 is greater than the distance between the apertures 317 and the top edge 331 of the side wall 318 so that the frame member 346 extends down the interior surface 347 of the side wall below the apertures 317.

Each of the tabs 394 is then pivoted, by means of the hinge, from the first position into the second position so that the engagement member 396 extends through a respective one of the apertures 317 of the side wall 318. In this embodiment the engagement members 396 extend fully through the apertures 317 and a distal end 355 of each of the engagement members 396 contacts the frame member 346.

Once all of the tabs 394 are in the second position, retaining means 399 in the form of an elongate strap or band 399 is secured around the outside of the tabs 394 such that the strap or band 399 locates in the channels 398 provided on the tabs 394. The strap or band 399 is tightened, i.e. a diameter of the strap 399 is decreased, so as to apply a radially inwardly directed force to the tabs 394 to retain the tabs 394 in the second position.

Figure 25:
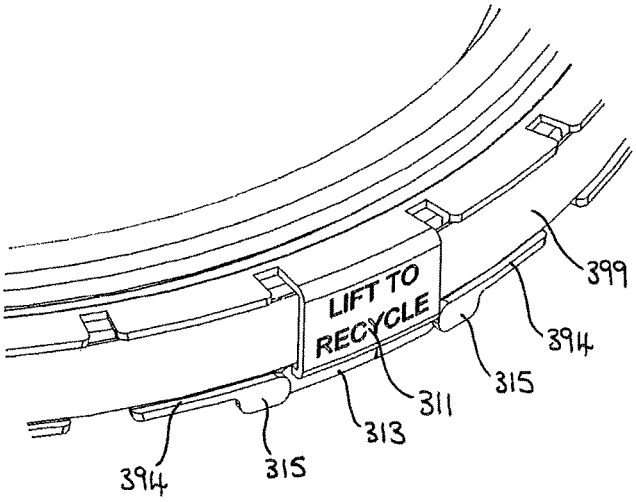
FIG. 25 is a view of a part of the assembly of FIG. 24, showing in particular a locking tab engaged with the securing tabs.

Locating the strap 399 in the channels 398 means that once the strap 399 has been tightened and secured, the strap 399 cannot be easily removed from around the securing portion 342. In this regard, preferred embodiments of the rim element 302 further comprise a locking tab 311 that extends over and covers the ends of the strap 399 once it has been secured around the securing portion 342. The locking tab 311, shown most clearly in FIGS. 18, 24 and 25, is hingedly connected to the frame member 346 in the same way as the securing tabs 394 and is located between two of the securing tabs 394. The locking tab 311 is, therefore, movable between a first position in which the locking tab 311 is not engaged with the retaining means 399 or tabs 394, shown in FIG. 18, and a second position in which the locking tab 311 extends down over the retaining strap 399, shown in FIGS. 24 and 25.

The locking tab 311 includes a latch plate 313 at a lower edge of the locking tab 311. A securing tab 394 located on either side of the locking tab 311 includes a latch lobe 315 that extends from a lower edge of the securing tab 394 in a direction towards the locking tab 311. During assembly of the container 301, once the securing tabs 394 have been moved into the second position and the retaining strap 399 has been tightened around the tabs 394, the locking tab 311 is then moved into its second position. Engagement of the latch plate 313 with the latch lobes 315 on the neighbouring tabs 394, due to a resilience of one or both of the latch lobes 315 and latch plate 313, retains the locking tab 311 in the second position so that the locking tab 311 covers the ends of the strap 399.

When a user wishes to removed the rim element 302 from the main body 308, a user applies a force to the locking tab 311 to disengage the latch plate 313 from the latch lobes 315, move the locking tab 311 into the first position and reveal the ends of the strap 399. A user can then unwrap the retaining strap 399 from around the securing tabs 394 to disengage the tabs 394 from the apertures 317. The securing tabs 394 are preferably biased so that when the strap 399 is removed the tabs 394 automatically move in a direction towards the first position such that the engagement members 396 disengage from the apertures 317.

The retaining strap 399 may be made from a suitable plastics material or a paperboard material having sufficient strength to retain the tabs 394 in the engaged position during storage and use of the container 301.

The container 301 preferably further comprises a lining (not shown) that extends over and covers the interior surfaces 347 of the main body 308. The lining is preferably made from a thin film plastics material and acts as a barrier layer preventing leakage of the contents of the container 301 through the paperboard main body 308. The barrier properties of the lining may additionally prevent moisture or gasses entering or leaving the container which may spoil or degrade the contents of the container 301.

The size and shape of the lining is such that it substantially conforms to the internal shape of the main body 308. In preferred embodiments an upper edge region of the lining locates between the side wall 318 of the main body 308 and the frame member 346 of the rim element 302. This upper edge region of the lining is bonded or welded to the frame member 346 so as to form a liquid-tight seal between the lining and the rim element 302.

The lining may be lightly adhered to the side wall 318 and base of the main body 308 to retain the lining in the correct position. The adhesion of the lining to the main body 308 is typically such that the lining can be separated from the main body 308 with the lining remaining intact. As such, once the container 301 has been used, the rim element 302 and the lining may be separated from the main body 308 of the container 301 for disposal or recycling. Because the lining is securely bonded to the frame member 346 of the rim element 302, the lining is removed together with the rim element 302.

In this embodiment the rim element 302 further comprises attachment means 368 for a handle. The attachment means 368 comprises a pair of attachment plates 368 connected to the frame member 346. Each of the attachment plates 368 includes an aperture 370 for receiving a part of an end of a handle. The attachment means 368 are preferably configured such that the handle may be pivotally attached to the rim element 302.

Figure 22:
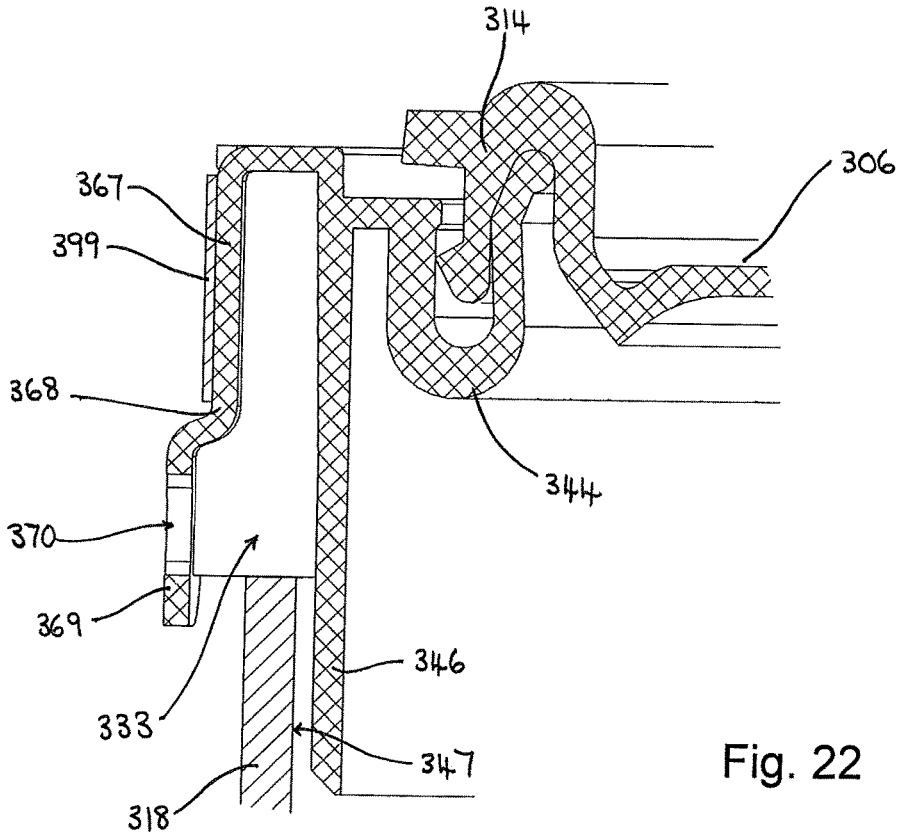
FIG. 22 is a cross-sectional detail view showing the rim element of FIG. 18 engaged with the main body of FIG. 20, and showing in particular an attachment portion of the rim element for connection to a handle.
Figure 23:
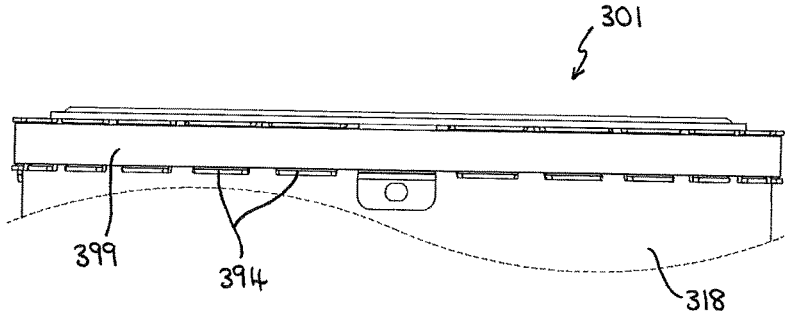
FIG. 23 is a side view of an assembly comprising the rim element of FIG. 18 engaged with the main body of FIG. 20, and illustrating a retaining strap engaged with the securing tabs.

Each of the attachment plates 368 includes a first, upper section 367 over which the retaining strap locates, as shown most clearly in FIGS. 22 and 24, and a second, lower section 369 in which the aperture 370 is located. In this way, the point of attachment of the handle to the rim element 302 is located further below the top edge 331 of the container 301 than the retaining means 399. Furthermore, the attachment plates 368 are configured such that the ends of the handle are located on an external side of both the side wall 318 of the main body 308 and the retaining strap 399.

When the rim element 302 is engaged with the top edge 331 of the main body 308, the attachment plates 368 are aligned with the notches 333 in the side wall 318 of the main body 308. As illustrated in FIG. 22, this provides sufficient clearance behind the attachment plates 268 to allow the ends of the handle to be easily attached and to permit free rotation of the ends of the handle about the attachment plates 368.

It will be appreciated that although the containers 1, 101, 201, 301 have been described above as separate examples or embodiments, features from one example or embodiment may be found in or incorporated into another one of the examples or embodiments. For example, although the container 301 has been described as being substantially cylindrical, the container 301 may have a rounded rectangular shape as described in relation to the first example of a container 1.

The present invention provides a rim element for a container, a container including a rim element and a method of forming a container including a rim element that enables the container to be repeatedly resealed and further enables plastics and paperboard parts, or contaminated and uncontaminated parts, of the container to be easily separated for disposal or recycling.

The invention claimed is:

1. A rim assembly for a container, the container comprising a main body and a lid, the main body including a side wall having a plurality of apertures and a top edge defining an opening of the container, and the rim assembly comprising:

a frame member having a perimeter corresponding in shape to said opening of the container such that, in use, the frame member is received within the opening and extends around an interior surface of the side wall of the main body;

a plurality of securing tabs hingedly connected to the frame member, each tab including an engagement member;

sealing means configured for repeated sealing engagement with said lid of the container; and retaining means, wherein, in use, each of the securing tabs is movable between a first position in which the engagement member is disengaged from said aperture and a second position in which the engagement member is engaged with one of said apertures, and wherein the retaining means is configured to retain the securing tabs in the second position such that the rim assembly is secured to the main body of the container around the top edge.

2. A rim assembly as claimed in claim 1, wherein the retaining means comprises a strap.

3. A rim assembly as claimed in claim 1, wherein, in use, when the securing tabs are in the second position each of the engagement members extends fully through the respective aperture.

4. A rim assembly as claimed in claim 1, wherein, when the securing tabs are in the second position, each of the engagement members contacts the frame member.

5. A rim assembly as claimed in claim 1, wherein, in use, when the securing tabs are in the second position, each of the securing tabs extends down over an exterior surface of the side wall of the main body.

6. A rim assembly as claimed in claim 1, wherein the frame member, securing tabs and sealing means are parts of a unitary rim element, and wherein each of the securing tabs is connected to the frame member by means of a live hinge.

7. A rim assembly as claimed in claim 1, wherein each of the securing tabs has a first surface and a second surface and the engagement member extends from the first surface, and wherein, in use, when the securing tabs are in the second position the retaining means is in contact with the second surface of each of the tabs.

8. A rim assembly as claimed in claim 1, wherein the sealing means and the securing tabs are provided on opposite sides of the frame member.

9. A rim assembly as claimed in claim 1, wherein the frame member is in the form of an annular member.

10. A rim assembly as claimed in claim 1, further comprising at least two attachment members connected to the frame member for attachment of a handle to the rim assembly and wherein, in use, when the retaining means is engaged with the securing tabs to retain said tabs in the second position, the point of attachment of said handle to each of the attachment members is further below the top edge of the container than the retaining means.

11. A rim assembly as claimed in claim 1, wherein the hinged connection between each of the securing tabs and the frame member is biased such that, in use, when the retaining means is removed the securing tabs are urged to move from the second position to the first position.

12. A container comprising:

a main body including a base and a side wall, the side wall having a top edge defining an opening of the container and a plurality of apertures;

a lid for covering the opening; and a rim assembly comprising:

a frame member that extends around an interior surface of the side wall of the main body below the top edge;

sealing means configured for repeated sealing engagement with the lid;

a plurality of securing tabs hingedly connected to the frame member, each tab including an engagement member, the engagement member of each tab being engaged with a respective one of the apertures; and retaining means configured to apply a force to the securing tabs to retain each engagement member in the respective aperture such that the rim assembly is secured to the main body around the top edge.

13. A container as claimed in claim 12, wherein the retaining means comprises a strap that extends around and applies a force to all of the securing tabs.

14. A container as claimed in claim 12, wherein the main body of the container is made of a paperboard material.

15. A container as claimed in claim 14, wherein the container further comprises a lining formed of a flexible, thin film plastics material, the lining being secured to the frame member of the rim assembly and the lining extending over and covering internal surfaces of the main body.

16. A container as claimed in claim 15, wherein the frame member, securing tabs and sealing means are parts of a unitary rim element, and the rim element is made of a relatively rigid plastics material.

17. A container as claimed in claim 15, wherein the lining is securely bonded to the frame member of the rim assembly and the lining is lightly adhered to the internal surfaces of the main body, such that, in use, the rim assembly and lining may be fully separated from the main body of the container.

18. A container as claimed in claim 12, further comprising a handle connected to the frame member of the rim assembly by means of attachment members located on an exterior side of the side wall of the main body.

19. A method of constructing a container, the container comprising a main body including a base and a side wall, the side wall having a top edge defining an opening of the container and a plurality of apertures formed in the side wall, and a rim assembly, and the method comprising:

inserting a frame member of the rim assembly through the opening so that the frame member extends around an interior surface of the side wall of the main body;

moving a plurality of securing tabs of the rim assembly from a first position in which the securing tabs are not engaged with the side wall of the main body to a second position in which an engagement member of each of the securing tabs is engaged with one of said apertures; and retaining the securing tabs in the second position by means of a retaining strap configured to apply a force to each of the securing tabs, such that the rim assembly is secured to the main body of the container around the top edge.

20. A method of constructing a container as claimed in claim 19, in which the container further comprises a lid for covering the opening, and wherein the method comprises engaging the lid with a sealing means of the rim assembly, the sealing means being configured for repeated sealing engagement with the lid of the container.

21. A method of constructing a container as claimed in claim 19, in which the container further comprises a lining covering interior surfaces of the main body, and wherein the method comprises:

securely bonding the lining to the frame member of the rim assembly, and lightly adhering the lining to the internal surfaces of the main body, such that, in use, the rim assembly and lining may be fully separated from the main body of the container.

* * * * *